US007581828B2

(12) United States Patent
Gibson et al.

(10) Patent No.: US 7,581,828 B2
(45) Date of Patent: Sep. 1, 2009

(54) FLUID EJECTION CARTRIDGE UTILIZING A TWO-PART EPOXY ADHESIVE

(75) Inventors: Lawrence E Gibson, San Diego, CA (US); Daniel T. Pogany, Cuyahoga Falls, OH (US); Jeffery S. Noss, Lakewood, OH (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 473 days.

(21) Appl. No.: 11/380,507

(22) Filed: Apr. 27, 2006

(65) Prior Publication Data

US 2006/0204690 A1 Sep. 14, 2006

Related U.S. Application Data

(63) Continuation of application No. 10/626,252, filed on Jul. 23, 2003, now Pat. No. 7,063,413.

(51) Int. Cl.
*B41J 2/18* (2006.01)

(52) U.S. Cl. ..... 347/91; 428/34.1; 428/355 R; 428/355 EP

(58) Field of Classification Search ..... 347/91, 347/87; 428/34.1, 355 R, 355 EP
See application file for complete search history.

(56) References Cited

U.S. PATENT DOCUMENTS

| | | | | |
|---|---|---|---|---|
| 3,874,493 | A * | 4/1975 | Boyd | 400/120.14 |
| 5,061,779 | A | 10/1991 | Wang | |
| 5,102,970 | A | 4/1992 | Wang | |
| 5,229,438 | A | 7/1993 | Ishida | |
| 6,019,457 | A * | 2/2000 | Silverbrook | 347/65 |
| 6,045,215 | A * | 4/2000 | Coulman | 347/47 |
| 6,299,272 | B1 * | 10/2001 | Baker et al. | 347/10 |
| 6,437,059 | B1 | 8/2002 | Tan | |
| 6,562,482 | B1 | 5/2003 | Sakamoto | |
| 6,562,884 | B1 | 5/2003 | Tang | |
| 6,565,935 | B1 | 5/2003 | Lohnes | |
| 6,565,977 | B2 | 5/2003 | Bae | |
| 6,572,971 | B2 * | 6/2003 | Martin | 428/414 |

FOREIGN PATENT DOCUMENTS

| | | | |
|---|---|---|---|
| DE | 142964 | A | 7/1980 |
| JP | 06183000 | A | 7/1994 |

* cited by examiner

*Primary Examiner*—Michael C Miggins

(57) ABSTRACT

A fluid ejection cartridge, including a substrate carrier having a substrate receiving surface, and a substrate having at least one fluid ejector actuator disposed on the substrate. In addition the fluid ejection cartridge includes a two-part adhesive disposed between the substrate and the substrate receiving surface. The two-part adhesive is an epoxy resin having a polyglycidyl ether of a polyhydric phenol, and a hardener having a cylcoaliphatic polyamine.

37 Claims, 3 Drawing Sheets

FLUID EJECTION CARTRIDGE UTILIZING A TWO-PART EPOXY ADHESIVE

This application is a continuation of U.S. Application Ser. No. 10/626,252, now U.S. Pat. No. 7,063,413.

BACKGROUND

Description of the Art

Over the past decade, substantial developments have been made in the micro-manipulation of fluids in fields such as electronic printing technology using inkjet printers. As the number and complexity of fluids manipulated or ejected increases, the susceptibility of the microfluidic device to degradation by components in those fluids may also increase. In addition, pressure to reduce weight and cost, and to increase manufacturing volume additional limitations or restrictions are placed on both the processes and the materials that may be utilized. Fluid ejection cartridges and fluid supplies provide a good example of the problems facing the practitioner in increasing the reliability and robustness these microfluidic devices.

Currently there is a wide variety of highly efficient inkjet printing systems in use, which are capable of dispensing ink in a rapid and accurate manner. However, there is a demand by consumers for ever-increasing improvements in speed and image quality. In addition, there is also increasing demand by consumers for longer lasting fluid ejection cartridges. One way to increase the speed of printing is to move the print or fluid ejection cartridge faster across the print medium. However, if the fluid ejection cartridge includes both the fluid reservoir and the energy generating elements then a longer lasting print cartridge typically would require a larger ink reservoir, with the corresponding increase in mass associated with the additional ink. This increase in mass requires more costly and complex mechanisms to move the print cartridge at even higher speeds to produce the increased printing speed. Color printers, typically, utilize a black ink cartridge and 3 color cartridges resulting in a further increase in mass, further exacerbating the problem by requiring four larger ink reservoirs to be moved at a higher speed.

Thus, in an effort to reduce the cost and size of ink jet printers and to reduce the cost per printed page, printers have been developed having small, moving printheads that are connected to large stationary ink supplies. This development is generally referred to as "off-axis" printing, and has allowed large ink supplies to be replaced as they are consumed without requiring the frequent replacement of the costly printheads containing the fluid ejectors and nozzle system. Such a system, however, places additional reliability burdens on the printhead.

Improvements in image quality have typically led to an increase in the organic content of inkjet inks. This increase in organic content generally leads to inks exhibiting a more corrosive nature, potentially resulting in the degradation of the materials coming into contact with such inks. Degradation of these materials by more corrosive inks raises reliability and material compatibility issues. These material compatibility issues generally relate to all the materials the ink comes in contact with. However, they are exacerbated in the printhead because, in an off-axis system, the materials around the fluid ejectors and nozzles need to maintain their functionality over a longer period of time. Without such an increased reliability the printhead will not be able to continue functioning properly through at least several replacements of the stationary ink supplies. Thus, degradation of these materials can lead to potentially catastrophic failures of the printhead.

For example, in many printheads various plastic materials made from polymers may be utilized to form micro fluidic channels as well as adhesives to attach various parts together. Many of these plastic materials, typically, utilize various additives, such as stabilizers, plasticizers, tackifiers, polymerization catalysts, and curing agents. These low molecular weight additives are typically added to improve various processes involved in the manufacture of the polymer and to reduce cost without severely impacting the material properties. The interaction of these low molecular weight additives and the components of the ink may give rise to a weakening of an adhesive joint or a polymer film interface. Failure of an adhesive joint or delamination of the polymer film may lead to ink penetrating to regions where active circuitry is located leading to the potential for either corrosion or electrical shorting, or both, all of which can be potentially fatal to the operation of the printhead. Since these additives, typically, are low in molecular weight compared to the molecular weight of the polymer, they can leach out of the polymer by the ink, react with ink components, or both, more easily than the polymer itself causing such problems. In either case, the reaction between these low molecular weight additives and ink components can also lead to the formation of precipitates or gelatinous materials, which can further result in degraded print or image quality. In addition, in a high humidity or moisture environment the retention of the chemical and physical properties of such polymeric material can also be a problem. All of these problems can impact the manufacture of lower cost, smaller, and more reliable printers.

If these problems persist, the continued growth and advancements in inkjet printing and other micro-fluidic devices, seen over the past decade, will be reduced. Consumer demand for cheaper, smaller, more reliable, higher performance devices constantly puts pressure on improving and developing cheaper, and more reliable manufacturing materials and processes. The ability to optimize fluid ejection systems will open up a wide variety of applications that are currently either impractical or are not cost effective.

DESCRIPTION OF THE PREFERRED EMBODIMENTS

Figure 1:
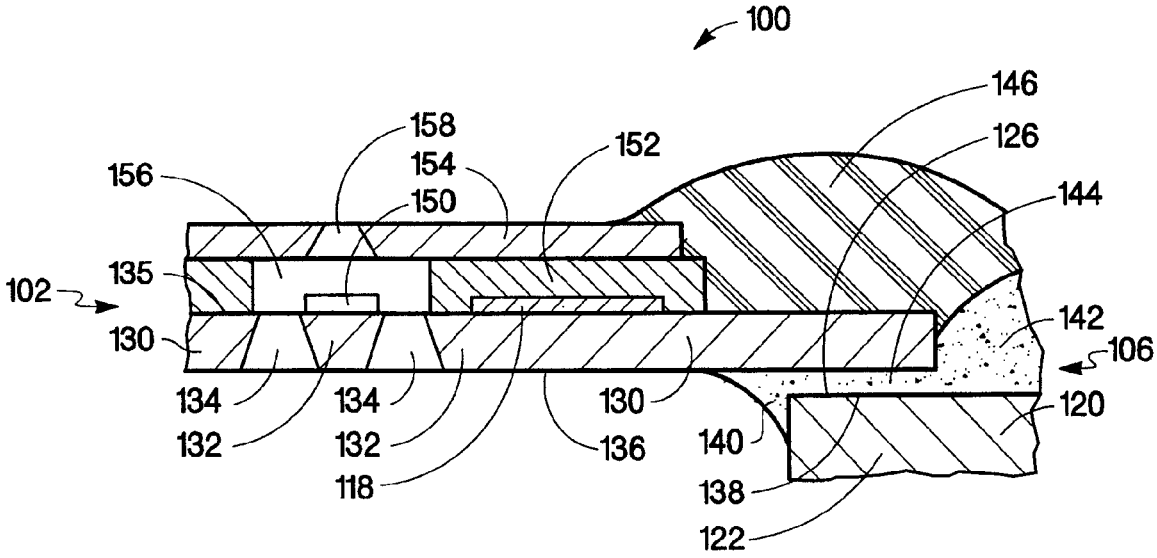
FIG. 1 is a cross-sectional view of a portion of a fluid ejector head according to an embodiment of the present invention.

Referring to FIG. 1, an embodiment of the present invention is shown in a simplified cross-sectional view. In this embodiment, fluid ejection cartridge 100 includes fluid ejector head 102 mounted to fluid ejection cartridge body 122 via substrate 132 utilizing two-part epoxy adhesive 140. Two-part epoxy adhesive 140 is a thermally cured epoxy, in this embodiment. Adhesive bead 142 provides a method of attachment between first adherend 120, the cartridge body, and second adherend 130, the substrate. Two-part epoxy adhesive 140 forms bonded structure 106 having adhesive thickness 144 between opposing surface 136 of second adherend 130 and substrate receiving surface 138 of first adherend 120. Cartridge body 122 includes substrate carrier portion 126, which includes substrate receiving surface 138. In addition, adhesive bead 142 also provides a fluid seal between substrate 132 and cartridge body 122.

Adhesive thickness 144 is in the range from about 200 micrometers to about 800 micrometers, in this embodiment. However, in alternate embodiments, adhesive thickness 144 may be in the range from about 10 micrometers to 1000 micrometers depending on the particular application in which fluid ejection cartridge 100 will be utilized. Further, in this embodiment adhesive bead 142 is dispensed on cartridge body 120, however, depending on the particular pen body material utilized, as well as the particular two-part epoxy adhesive used, adhesive bead 142 may be dispensed on substrate 132 in alternate embodiments.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention to presently preferred embodiments.

In this embodiment, substrate 132 has fluid ejector actuator 150 formed on device surface 135. Substrate 132, in this embodiment, is a silicon integrated circuit including transistors and other logic devices. Substrate 132 is a crystalline silicon substrate having a thickness of about 300-800 micrometers. However, in alternate embodiments, materials such as various glasses, ceramic such as aluminum oxide, boron nitride, silicon carbide, sapphire, semiconductors such as gallium arsenide, indium phosphide, germanium, polysilicon, various polymers such as polyimides, and polycarbonates also may be utilized. The transistors, other logic devices, electronic components, and electrical circuits are formed on device surface 135. Active devices 118 are represented as only a single layer in FIG. 1 on device surface 135 to simplify the drawing. Those skilled in the art will appreciate that active devices 118 may be realized as a stack of thin film layers. In alternate embodiments, "direct drive" structures may also be utilized. In a direct drive application each fluid ejector actuator is electrically connected to a bond pad (not shown). In direct drive applications, substrate 132 may be formed from any material suitable for forming fluid ejector actuator 150 such as, for example, glass, ceramic, or polymer substrates.

Accordingly, the present invention is not intended to be limited to those devices fabricated in silicon semiconductor materials, but will include those devices fabricated in one or more of the available semiconductor materials and technologies known in the art, such as thin-film-transistor (TFT) technology using polysilicon on glass substrates. Further, substrate 132 is not restricted to typical wafer sizes, and may include processing a polymer sheet or film or glass sheet or even a single crystal sheet or a substrate handled in a different form and size than that of conventional wafers or substrates. The actual substrate material utilized will depend on various parameters such as the particular fluid ejector actuator utilized, the particular fluid being ejected, the size and number of fluid ejector actuators utilized in the particular fluid ejector head, and the environment to which the fluid ejector head will be subjected.

As shown in FIG. 1, fluid ejector actuator 150 may be any device capable of imparting sufficient energy to the fluid to cause ejection of fluid from chamber 156 such as compressed air actuators, electromechanical actuators, or thermal mechanical actuators. Fluid definition layer 152 forms fluidic chamber 156 around fluid ejector actuator 150, so that when fluid ejector actuator 150 is activated, fluid is ejected out of bore 158, which is generally located proximate to fluid ejector actuator 150. Fluid channels 134 formed in substrate 132 provide a fluidic path for fluid in a reservoir (See FIG. 3) to fill fluidic chamber 156. Orifice layer 154 is formed over fluid definition layer 152. Orifice layer 154 may be formed of metal, polymer, glass, or other suitable material such as ceramic. For example, a photodefinable polymer such as photodefinable polyimides, benzocyclobutenes, or epoxies can be utilized to form both orifice layer 154 and fluid definition layer 152. In addition, in still other embodiments, orifice layer 154 can also be formed from a metal such as a nickel base enclosed by a thin gold, palladium, tantalum, or rhodium layer. Further, in this embodiment, encapsulant 146 may also utilize a two-part epoxy of the present invention or other polymeric material providing mechanical support, as well as, moisture and corrosion protection to electrical interconnections, bond pads, and electrical traces between cartridge body 122 and substrate 132.

Figure 2:
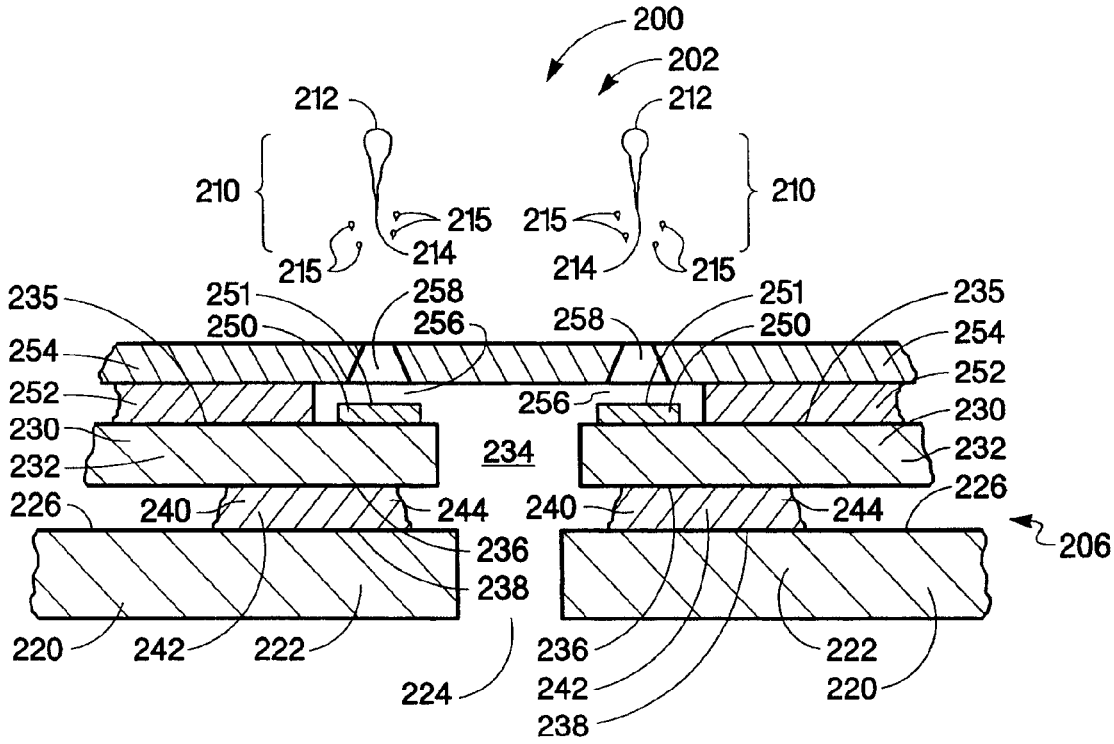
FIG. 2 is a cross-sectional view of a portion of a fluid ejector head according to an alternate embodiment of the present invention.

Two-part epoxy adhesive 140 includes a first part commonly referred to as the resin having a polyglycidyl ether of a polyhyrdric phenol, and a second part commonly referred to as the hardener having a cycloaliphatic polyamine. Examples of polyepoxides that may be utilized in the present invention are those that are based upon phenols, aliphatic polyols and mixtures thereof. Representative phenolic polyepoxides include polyglycidyl ethers of polyhydric phenols derived from a polyhydric phenol and epihalohydrin. Epihalohydrins used in preparing the polyepoxides may include epichlorohyrdrin and epibromohyrdrin. Haloepoxyalkanes may also be utilized to form epoxy polymers containing epoxyalkoxy groups. Examples of haloepoxyalkanes that may also be utilized are, 1-chloro-2,3-epoxybutane, 1-chloro-2-methyl-2,3-epoxypropane, 1-bromo-2,3-epoxypentane, and 1-chloro-2,3-epoxyoctane. Polyhydric phenols include di(4-dihyrdoxyphenyl)methane, commonly referred to as bisphenol F, and di(4-dihyrdoxyphenyl)propane, commonly referred to as bisphenol A as well as resorcinol. The resulting polyepoxides generally have an epoxide equivalent weight ranging from about 156 to about 356 for bisphenol A and F epoxies and from about 120 to about 470 for other epoxies. The particular value utilized will depend on the particular application in which fluid ejection cartridge 200, such as shown in FIG. 2, will be used. An epoxide equivalent weight ranging from about 160 to about 180 may be utilized, in this embodiment. In this embodiment, the resin comprises from about 70 weight percent to about 78 weight percent of the total weight of the adhesive. However, in alternate embodiments, the resin may range from about 63 weight percent to about 85 weight percent depending on the particular application in which the fluid ejection cartridge is utilized and assuming resin materials with similar equivalent weights as described above are utilized.

The resin is a polyglycidyl ether of a polyhyrdric phenol utilizing bisphenol F as the polyhydric phenol, in this embodiment. An example of a commercially available resin material that may be utilized is sold by Vantico, under the name Araldite GY 285. Other examples of commercially available resin materials that may also be utilized include Epon 862 sold by Resolution Performance Products, and DER 354 sold by Dow Chemical Inc. In alternate embodiments, the resin may include a bisphenol A type epoxy resin, epoxy novolac resin, an epoxy phenolic novolac resin, a cresol glycidyl ether, an aliphatic glycidyl ether having C8 to C18 alkyl groups, an alkyl gylcidyl ether having C4 to C12 alkyl groups, a polypropylene glycol based resin, a 1,4-butanediol diglycidyl ether, triglycidylether of trimethylolpropane, 4-glycidoxy-N, N-diglycidyl aniline, halogenated phenoxy epoxy resins, epoxyalkoxy resins, and mixtures thereof. The particular resin and epoxide equivalent weight utilized will depend on various parameters such as the expected cartridge life, the particular fluid being ejected, and the particular material utilized for the cartridge body.

The cycloaliphatic polyamine, in this embodiment, is 3-aminomethyl-3,5,5-trimethyl-1-cyclohexylamine commonly referred to as isophorone diamine. However, in alternate embodiments, diethylenetriamine, triethylenetetramine, poly(oxypropylene diamine), poly(oxypropylene triamine), polyglycolamine, m-phenylene diamine, 4,4'-diaminodiphenyl sulfone, 4,4'-diaminodiphenyl methane, N-aminoethylpiperazine, 1,2-diaminocyclohexane, 1,3-diaminocyclohexane, 1,4-diamino-3,6-diethylcyclohexane, 2,2-di(4-aminocylcohexyl) propane, di(4-aminocyclohexyl) methane, and mixtures thereof may also be utilized depending on the particular application in which the fluid ejection cartridge will be utilized. An example of a commercially available polyamine curing agent that may be utilized is sold by Vantico, under the name Aradur 2962 (42BD). In still other embodiments, aromatic or aliphatic amines in the range from about 1 weight percent to about 20 weight percent of the total amine weight utilized may also be added with the cycloaliphatic amine used. In this embodiment, the polyamine curing agent is usually present in the range from about 16.5 weight percent to about 19 weight percent of the total weight of adhesive. However, in alternate embodiments, the polyamine curing agent may range from about 13 weight percent to about 24 weight percent with similar equivalent weight epoxy resin.

The adhesive composition of the present invention may also contain a thixotrope or thickening agent. In this embodiment, both a treated and untreated fumed silica is utilized. However, any fumed silica, as well as clays, nanoclays, talcs, calcium carbonates, and mixtures thereof may also be utilized in alternate embodiments. Any thixotrope that provides the desired rheology for dispensing the adhesive may be utilized. The same or different thixotropes may be added to either the resin or hardener or both to adjust both the viscosity of the two parts as well as to provide uniform mixing through a static mixer. For example, in this embodiment, the resin includes a treated fumed silica sold by Cabot Inc. under the name Cab-O-Sil TS 720 in the range from about 4.1 weight percent to about 4.3 weight percent of the total weight of adhesive. In addition, the hardener includes an untreated fumed silica sold by Cabot Inc. under the name Cab-O-Sil PTG in the range from about 0.3 weight percent to about 0.45 weight percent of the total weight of adhesive. In alternate embodiments, the treated fumed silica may range from about 1 weight percent to about 5 weight percent, and the untreated fumed silica may range from about 0.1 weight percent to about 3 weight percent. In still other embodiments, the thixotrope utilized may range from about 0.1 weight percent to about 10 weight percent.

The adhesive composition of the present invention also may contain a filler utilized to adjust the mix volume ratio. In this embodiment, low density glass spheres are utilized to adjust the mix volume ratio to 4:1. However, in alternate embodiments, other ratios may also be utilized such as 3:2 or 4:5 as well as ratios ranging from 1:1 to 10:1. In addition, utilization of glass spheres also reduces the coefficient of thermal expansion (CTE) of the cured adhesive which may be advantageous when bonding to materials having a low CTE such as silicon. An example of a commercially available filler that may be utilized is sold by 3M Corporation, under the name Scotchlite K-20. The amount of filler utilized will depend on various parameters such as the CTE desired, the particular cartridge body material utilized, and the amounts of other materials utilized in formulating the adhesive composition. In this embodiment the low density glass spheres are in the range from about 3.3 weight percent to about 3.5 weight percent, however, in alternate embodiments, the low density glass spheres may range from about 3 weight percent to about 5 weight percent. In alternate embodiments, other materials may also be utilized as a filler, such as glass spheres, ceramic spheres, polymer spheres, barium sulfate, barium titanate, silicon oxide powder, amorphous silica, talc, clay, mica powder, and mixtures thereof.

A silane coupling agent may also be utilized in the adhesive composition of the present invention. In this embodiment, gamma-aminopropyltriethoxysilane coupling agent is added to the hardener part in the range from about 0.2 weight percent to about 1 weight percent. In alternate embodiments, the silane coupling agent may range up to about 2 weight percent. In still other embodiments, any of the other amine, mercaptan or epoxy type silane coupling agents may also be utilized. N-beta-(aminoethyl)-gamma-aminopropyltriethoxysilane, gamma-glycidoxypropyltrimethoxysilane, gamma-mercaptopropyltrimethoxysilane, beta-(3,4-epoxycyclohexyl)ethyltrimethoxysilane, and gamma-aminopropyltrimethoxysilane are just a few examples of the many silane coupling agents that may be utilized.

A pigment may also be utilized in the adhesive composition of the present invention. Pigments are utilized to provide a visual reference of the proper mixing of the two components as they are combined. In this embodiment, a yellow dye such as food yellow 5 is added to the resin and a red dye such as food red 3 is added to the hardener. However, in alternate embodiments, any dye or pigment or combination thereof may also be utilized. In this embodiment, the dye is added in the range from about 0.005 weight percent to about 0.1 weight percent. However, in alternate embodiments, any amount up to about 1 weight percent may also be utilized.

An exemplary composition of a two-part epoxy adhesive utilized in the present invention includes a resin having from about 70 weight percent to about 78 weight percent of a bisphenol F diglycidyl ether; from about 4.1 to about 4.3 weight percent of a treated fumed silica; and from about 3.3 to about 3.5 weight percent of low density glass spheres. Further, the exemplary composition includes a hardener having from about 16.5 to about 19.0 weight percent of isophorone diamine; from about 0.2 to about 2 weight percent of gamma-aminopropyltriethoxysilane coupling agent; and from about 0.3 to about 0.45 weight percent of untreated fumed silica.

Referring to FIG. 2, an alternate embodiment, of the present invention is shown in a simplified cross-sectional view. In this embodiment, fluid ejection cartridge 200 includes fluid ejector head 202 where first adherend 220 is substrate carrier 222 and second adherend 230 is substrate 232. In this embodiment, substrate carrier 222 is a ceramic chip carrier, and substrate 232 is a silicon die. Two-part epoxy adhesive 240 forms bonded structure 206 having adhesive thickness 244 between opposing surface 236 of second adherend 230 and substrate receiving surface 238 of first adherend 220. Adhesive bead 242 provides a method of attachment between silicon die 232 and ceramic chip carrier 222. In addition, adhesive bead 242 also provides a fluid seal between silicon die 232 and ceramic chip carrier 222. Ceramic chip carrier 222 includes fluid channel 224 providing fluidic coupling between fluid in a reservoir (See 362 in FIG. 3) and fluid inlet channel 234 formed in silicon die 232. In alternate embodiments, ceramic chip carrier 222 may be a multilayer ceramic chip carrier (MCC) having micro-fluidic paths or channels providing fluidic coupling to particular fluid ejectors 250, as well as, electrical traces formed in various layers in the MCC providing electrical interconnections to silicon die 232. Ceramic chip carrier 222 includes substrate carrier portion 226, which includes substrate receiving surface 238.

In this embodiment, two-part adhesive 240 is a thermally cured two-part epoxy, utilizing any of the compositions described above. Adhesive thickness 244 is in the range from about 400 micrometers to about 700 micrometers, in this embodiment. However, in alternate embodiments, adhesive thickness may be in the range from about 25 micrometers to 1000 micrometers depending on the particular application in which fluid ejector head 202 will be utilized. Further, in this embodiment adhesive bead 242 is dispensed on ceramic chip carrier 222, and two-part adhesive 240 has a viscosity in the range from about 20,000 centipoise to about 500,000 centipoise measured at a high shear of about 15 revolutions per minute on the parallel plates of the rheometer. As noted above depending on the particular application adhesive bead 242 may be dispensed on silicon die 232 as well.

Silicon die 232 includes device surface 235 on which electronic components and electrical circuits are formed and opposing surface 236. In this embodiment, silicon die 232 is a silicon integrated circuit including transistors and other logic devices (not shown), however, any of the materials described above that support active and passive devices may also be utilized. In addition, silicon die 232 has fluid ejector actuators 250 formed on device surface 235. "Direct drive" structures may also be utilized in alternative embodiments. In a direct drive application each fluid ejector is electrically connected to a bond pad (not shown).

As shown in FIG. 2, in this embodiment, fluid ejector actuator 250 includes energy generating element 251, which is a thermal resistor. In alternate embodiments, other energy generating elements such as piezoelectric, flex-tensional, acoustic, and electrostatic elements may be utilized. Chamber layer 252 is formed on device surface 235 of silicon die 232, and forms fluidic chamber 256 around energy generating element 251, so that when fluid ejector actuators 250 are activated fluid is ejected out of nozzles 258, which are generally located proximate to fluid energy generating elements 251. Fluid inlet channel 234 is formed in silicon die 232, and extends from opposing surface 236 to device surface 235. Fluid inlet channel 234 provides a fluidic path for fluid to fill fluidic chamber 256. Nozzle layer 254 is formed over chamber layer 252. Nozzle layer 254 may be formed of similar materials as described above for the embodiment shown in FIG. 1.

In this embodiment, an energy impulse applied across the thermal resistor rapidly heats at least one component in the fluid above its boiling point causing vaporization of the fluid component resulting in an expanding bubble that ejects fluid drop 210 as shown in FIG. 2. Fluid drop 210 typically includes droplet head 212, drop-tail 214, and satellite-drops 215, which may be characterized as essentially a fluid drop. In such an embodiment, each activation of energy generating element 251 results in the ejection of a precise quantity of fluid in the form of essentially a fluid drop; thus, the number of times the fluid energy generating element is activated controls the number of drops 210 ejected from nozzle 258 (i.e. n activations results in essentially n fluid drops). Thus, fluid ejection cartridge 200 may generate deposits of discrete droplets of a fluid, including a solid material dissolved in one or more solvents or suspended or dispersed in the fluid, onto a discrete predetermined location on the surface of a receiving medium The drop volume of fluid drop 210 may be optimized by various parameters such as nozzle bore diameter, nozzle layer thickness, chamber dimensions, chamber layer thickness, energy generating element dimensions, and the fluid surface tension to name a few. Thus, the drop volume can be optimized for the particular fluid being ejected as well as the particular application in which fluid ejection cartridge 200 will be utilized. Fluid ejection cartridge 200 described in this embodiment can reproducibly and reliably eject drops in the range of from about 5 femto-liters to about 900 pico-liters depending on the parameters and structures of the fluid ejector head as described above. In this embodiment the term fluid may include any fluid material such as inks, adhesives, lubricants, chemical or biological reagents, as well as fluids containing dissolved or dispersed solids in one or more solvents.

Figure 3:
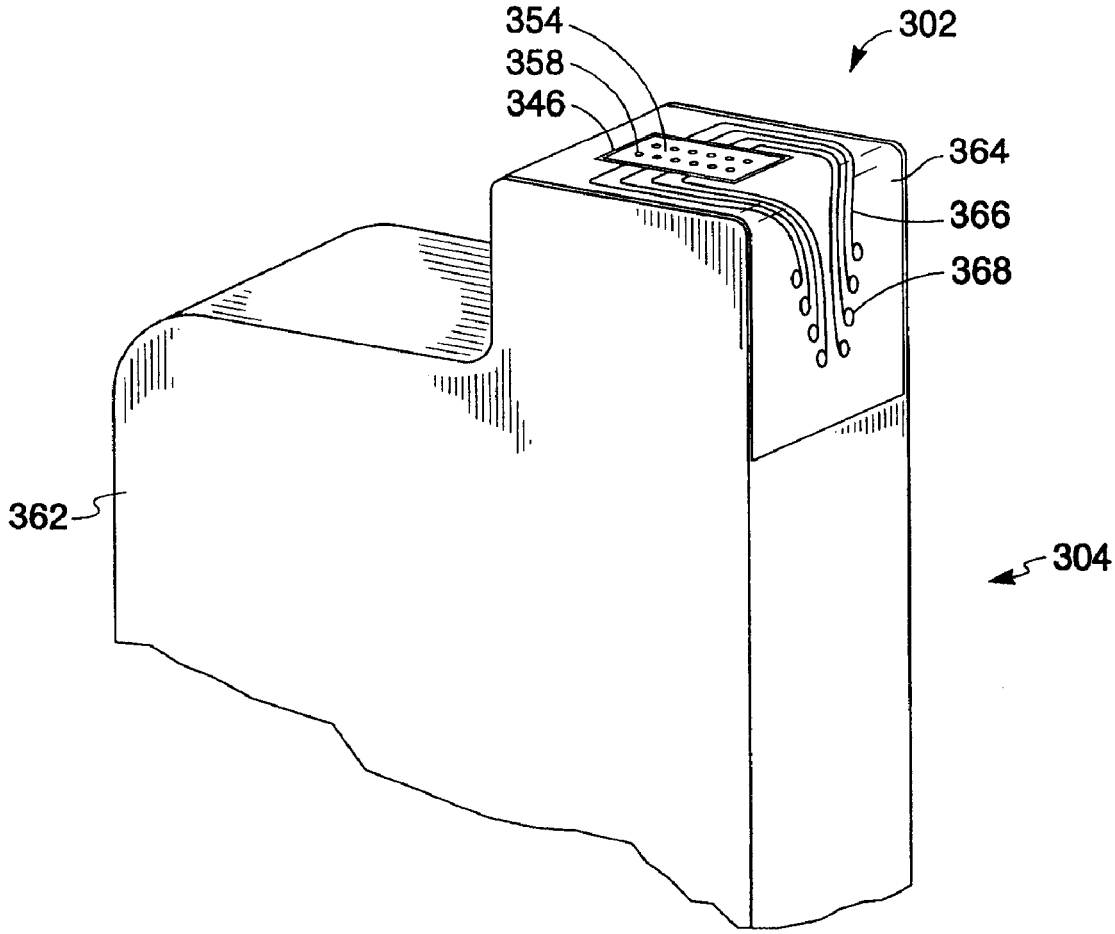
FIG. 3 is a perspective view of a portion of a fluid ejection cartridge according to an embodiment of the present invention.

Referring to FIG. 3, an alternate embodiment of the present invention is shown in a simplified perspective view. In this embodiment, fluid ejection cartridge 304 includes fluid reservoir 362 fluidically coupled to fluidic chambers (see, for example, FIGS. 1 and 2) in fluid ejector head 302. Nozzle layer 354 contains one or more nozzles 358 through which fluid is ejected. Ejector head 302 includes the substrate (not shown), nozzle layer 354, and nozzles 358.

In this embodiment, flexible circuit 364 is a polymer film and includes electrical traces 366 connected to electrical contacts 368. Electrical traces 366 are routed from electrical contacts 368 to bond pads on the silicon die or substrate (not shown) to provide electrical connection for the fluid ejection cartridge 304. Encapsulation beads 346 are dispensed along the edge of nozzle layer 354 and the edge of the substrate enclosing the end portion of electrical traces 366 and the bond pads on the substrate. In this embodiment encapsulation beads 346 are formed using a two-part epoxy adhesive that includes the resin having a polyglycidyl ether of a polyhyrdric phenol, and the hardener having a cycloaliphatic polyamine. Depending on the particular application in which fluid ejection cartridge 304 may be utilized, any of the two-part epoxies described above may be used.

What is claimed is:

1. A fluid ejection cartridge, comprising:

a substrate carrier having a substrate receiving surface;

a substrate having at least one fluid ejector actuator disposed on said substrate; and a two-part adhesive disposed between said substrate and said substrate receiving surface, wherein said two-part adhesive comprises:

an epoxy resin having a polyglycidyl ether of a polyhydric phenol; and a hardener having a cycloaliphatic polyamine.

2. The fluid ejection cartridge in accordance with claim 1, further comprising a reservoir fluidically coupled to said at least one fluid ejector actuator.

3. The fluid ejection cartridge in accordance with claim 1, further comprising a cartridge body coupled to said substrate carrier.

4. The fluid ejection cartridge in accordance with claim 1, wherein said substrate carrier further comprises a ceramic chip carrier.

5. The fluid ejection cartridge in accordance with claim 1, further comprising a reservoir fluidically coupled to said substrate.

6. The fluid ejection cartridge in accordance with claim 1, wherein said fluid reservoir contains an ejectable fluid fluidically coupled to at least one nozzle.

7. The fluid ejection cartridge in accordance with claim 1, wherein said polyglycidyl ether of a polyhydric phenol is a glycidyl ether of bisphenol A.

8. The fluid ejection cartridge in accordance with claim 1, wherein said polyglycidyl ether of a polyhydric phenol is a glycidyl ether of bisphenol F.

9. The fluid ejection cartridge in accordance with claim 1, wherein said cycloaliphatic polyamine is a cyclohexyl polyamine.

10. The fluid ejection cartridge in accordance with claim 1, wherein said epoxy resin further comprises a resin selected from the group consisting of a bisphenol type epoxy resin, an epoxy novolac resin, an epoxy phenolic novolac resin, a cresol glycidyl ether, an aliphatic glycidyl ether having C8 to C18 alkyl groups, an alkyl gylcidyl ether having C4 to C12 alkyl groups, a polypropylene glycol based resin, a 1,4 butanediol diglycidyl ether, triglycidylether of trimethylolpropane,4-glycidoxy-N,N-diglycidyl aniline, halogenated phenoxy epoxy resins, epoxyalkoxy resins, and mixtures thereof.

11. The fluid ejection cartridge in accordance with claim 1, wherein said hardener further comprises a hardener selected from the group consisting of 3-aminomethyl-3,5,5-trimethyl-1-cyclohexylamine, diethylenetriamine, triethylenetetramine, poly(oxypropylene diamine), poly(oxypropylene triamine), polyglycolamine, m-phenylene diamine, 4,4'-diaminodiphenyl sulfone, 4,4'-diaminodiphenyl methane, N-aminoethylpiperazine, 1,2-diaminocyclohexane, 1,3-diaminocyclohexane, 1,4-diamino-3,6-diethylcyclohexane, 2,2-di(4-aminocyclohexyl) propane, di(4-aminocyclohexyl) methane, and mixtures thereof.

12. The fluid ejection cartridge in accordance with claim 1, further comprising at least one nozzle proximate to said at least one fluid ejector actuator disposed over said substrate.

13. The fluid ejection cartridge in accordance with claim 12, wherein said fluid ejector actuator further comprises a fluid energy generating element.

14. The fluid ejection cartridge in accordance with claim 13, wherein activation of said fluid energy generating element ejects essentially a drop of a fluid from said at least one nozzle, and the volume of the fluid, of essentially said drop, is in the range of from about 5 femto-liters to about a 900 pico-liters.

15. The fluid ejection cartridge in accordance with claim 14, wherein said fluid energy generating element is a thermal resistor.

16. The fluid ejection cartridge in accordance with claim 14, wherein said fluid energy generating element is a piezoelectric actuator.

17. The fluid ejection cartridge in accordance with claim 14, wherein said fluid energy generating element is a acoustic actuator.

18. The fluid ejection cartridge in accordance with claim 1, further comprising a fluid definition layer.

19. The fluid ejection cartridge in accordance with claim 18, wherein said fluid definition layer further comprises:

a chamber layer defining sidewalls of a chamber; and an orifice layer defining a bore.

20. The fluid ejection cartridge in accordance with claim 19, further comprising fluid inlet channels formed in said substrate and fluidically coupled to said chamber.

21. The fluid ejection cartridge in accordance with claim 1, further comprising:

at least one active device disposed on said substrate; and an electrical trace electrically coupling said at least one active device to said at least one fluid ejector actuator.

22. The fluid ejection cartridge in accordance with claim 21, wherein said active device further comprises a transistor.

23. The fluid ejection cartridge in accordance with claim 1, wherein said two-part adhesive further comprises a thixotrope.

24. The fluid ejection cartridge in accordance with claim 23, wherein said thixotrope is selected from the group consisting of fumed silicas, clays, nanoclays, talcs, calcium carbonates, and mixtures thereof.

25. The fluid ejection cartridge in accordance with claim 1, wherein said two-part adhesive further comprises a silane coupling agent.

26. The fluid ejection cartridge in accordance with claim 25, wherein said silane coupling agent is in the range from about 0.2 weight percent to about 2.0 weight percent.

27. The fluid ejection cartridge in accordance with claim 1, wherein said two-part adhesive further comprises a filler.

28. The fluid ejection cartridge in accordance with claim 27, wherein said filler is added to adjust a mix volume ratio of said epoxy resin and said hardener in the range from about 4 to about 1.

29. The fluid ejection cartridge in accordance with claim 27, wherein said filler is added to adjust a mix volume ratio of said epoxy resin and said hardener in the range from about 1:1 to about 10:1.

30. The fluid ejection cartridge in accordance with claim 27, wherein said filler is selected from the group consisting of glass spheres, low density glass spheres, ceramic spheres, polymer spheres, barium sulfate, barium titanate, silicon oxide powder, amorphous silica, talc, clay, mica powder, and mixtures thereof.

31. The fluid ejection cartridge in accordance with claim 1, wherein said two-part adhesive further comprises a pigment providing visual reference of proper mixing of said epoxy resin and said hardener.

32. The fluid ejection cartridge in accordance with claim 31, wherein said pigment is in the range from about 0.005 weight percent to about 1 weight percent.

33. A fluid ejection cartridge, comprising:

a substrate having means for ejecting a fluid;

means for supporting said substrate; and means for adhering said substrate to said means for supporting said substrate, said means for adhering includes a two-part adhesive having:

an epoxy resin having a polyglycidyl ether of a polyhydric phenol; and a hardener having a cycloaliphatic polyamine.

34. The fluid ejection cartridge in accordance with claim 33, wherein said means for ejecting said fluid further comprises means for ejecting essentially a drop of said fluid, and the volume of said fluid is in the range of from about 5 femto-liters to about 900 pico-liters.

35. The fluid ejection cartridge in accordance with claim 33, further comprising:

means for forming a chamber; and means for forming a nozzle.

36. The fluid ejection cartridge in accordance with claim 33, further comprising means for performing logic on said substrate.

37. The fluid ejection cartridge in accordance with claim 33, wherein said cycloaliphatic polyamine is 3-aminomethyl-3,5,5-trimethyl-1-cyclohexylamine.

* * * * *

UNITED STATES PATENT AND TRADEMARK OFFICE

CERTIFICATE OF CORRECTION

PATENT NO. : 7,581,828 B2
APPLICATION NO. : 11/380507
DATED : September 1, 2009
INVENTOR(S) : Lawrence E. Gibson et al.

It is certified that error appears in the above-identified patent and that said Letters Patent is hereby corrected as shown below:

In column 9, line 20, in Claim 10, delete "gylcidyl" and insert -- glycidyl --, therefor.

In column 9, lines 22-23, in Claim 10, delete "trimethylolpropane,4-glycidoxy-N,N-diglycidyl" and insert -- trimethylolpropane, 4-glycidoxy-N,N-diglycidyl --, therefor.

Signed and Sealed this

Tenth Day of August, 2010

David J. Kappos

David J. Kappos
*Director of the United States Patent and Trademark Office*